US006657518B1

(12) United States Patent
Weller et al.

(10) Patent No.: US 6,657,518 B1
(45) Date of Patent: Dec. 2, 2003

(54) NOTCH FILTER CIRCUIT APPARATUS

(75) Inventors: Thomas M. Weller, Lutz, FL (US); Matthew C. Smith, Largo, FL (US); James W. Culver, Seminole, FL (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/164,949

(22) Filed: Jun. 6, 2002

(65) Prior Publication Data

(65)

(51) Int. Cl.[7] ..... H01P 1/203

(52) U.S. Cl. ..... 333/204; 333/202; 333/33; 333/133; 385/131; 385/129; 257/453; 257/76; 257/245

(58) Field of Search ..... 333/202, 204, 333/33, 189, 133; 257/453, 76, 751, 245; 385/129, 14, 131

(56) References Cited

U.S. PATENT DOCUMENTS

| | | | | | |
|---|---|---|---|---|---|
| 5,796,906 | A | * | 8/1998 | Narayanan et al. | 385/129 |
| 5,894,538 | A | * | 4/1999 | Presby | 385/129 |
| 5,966,478 | A | * | 10/1999 | Marcuse et al. | 385/14 |
| 6,100,775 | A | * | 8/2000 | Wen | 333/33 |
| 6,225,878 | B1 | * | 5/2001 | Takahashi et al. | 333/204 |
| 6,307,450 | B2 | * | 10/2001 | Takahashi et al. | 333/204 |
| 6,539,253 | B2 | * | 3/2003 | Thompson et al. | 607/2 |

* cited by examiner

*Primary Examiner*—Michael Tokar
*Assistant Examiner*—Lam T. Mai
(74) *Attorney, Agent, or Firm*—Baker Botts L.L.P.

(57) ABSTRACT

According to one embodiment of the invention, a notch filter circuit includes a coplanar waveguide that includes a silicon substrate and at least one shunt stub bent at an angle to the coplanar waveguide. The notch filter circuit also includes at least one capacitor bridging at least one discontinuity of the shunt stub.

17 Claims, 3 Drawing Sheets

NOTCH FILTER CIRCUIT APPARATUS

TECHNICAL FIELD OF THE INVENTION

This invention relates generally to filters and more particularly to a notch filter circuit apparatus.

BACKGROUND OF THE INVENTION

In many circuits it is desirable to operate the circuit so that one frequency signal is highly attenuated, while a desired frequency signal is left unattenuated. A circuit input, for example, may include not only a fundamental frequency signal, but may also include second, third, fourth, and higher harmonic frequency signals. In some circuit implementations it may be required to pass the fundamental frequency signal while blocking a specific harmonic signal. A notch, or bandstop, filter is the most appropriate filter to meet this requirement. A bandpass filter that discriminates against a wide range of frequency signals outside the passband may not provide the desired results.

Notch filters are often realized using distributed transmission line stubs, which can occupy significant substrate space. In conventional coplanar waveguide circuits, a notch filter may be created by symmetrically placing shunt stubs on opposite sides of the coplanar waveguide line. Conventional methods for reducing stub length, and therefore scarce substrate space, include using bent shunt stubs, meander structures, or capacitive loading. Notch filters employing these methods may be difficult to control over a broad frequency band or in more than one narrow frequency band of interest.

SUMMARY OF THE INVENTION

According to one embodiment of the invention, a notch filter circuit includes a coplanar waveguide that is located on a silicon substrate and at least one shunt stub bent at an angle to the coplanar waveguide. The notch filter circuit further includes at least one capacitor bridging at least one discontinuity of the shunt stub.

Some embodiments of the invention provide numerous technical advantages. Other embodiments may realize some, none, or all of these advantages. For example, according to one embodiment, a notch filter circuit utilizes at least one metal-insulator-metal capacitor in place of an air bridge or wire-bond to reduce the physical size of the notch filter. In some embodiments, the metal-insulator-metal capacitor also provides coplanar waveguide ground equalization. In addition the notch filter circuit may be implemented on a high-resistivity silicon substrate. In some embodiments, multiple metal-insulator-metal capacitors are located at specific positions along the length of stub to allow the filter pass-band and stop-band to be properly selected.

Other advantages may be readily ascertainable by those skilled in the art from the following FIGURES, description, and claims.

BRIEF DESCRIPTION OF THE DRAWINGS

For a more complete understanding of the present invention and the advantages thereof, reference is now made to the following description taken in conjunction with the accompanying drawings, wherein like reference numbers represent like parts, and which.

DETAILED DESCRIPTION OF EXAMPLE EMBODIMENTS OF THE INVENTION

Embodiments of the invention are best understood by referring to FIGS. 1 through 6 of the drawings, like numerals being used for like and corresponding parts of the various drawings.

Figure 1:
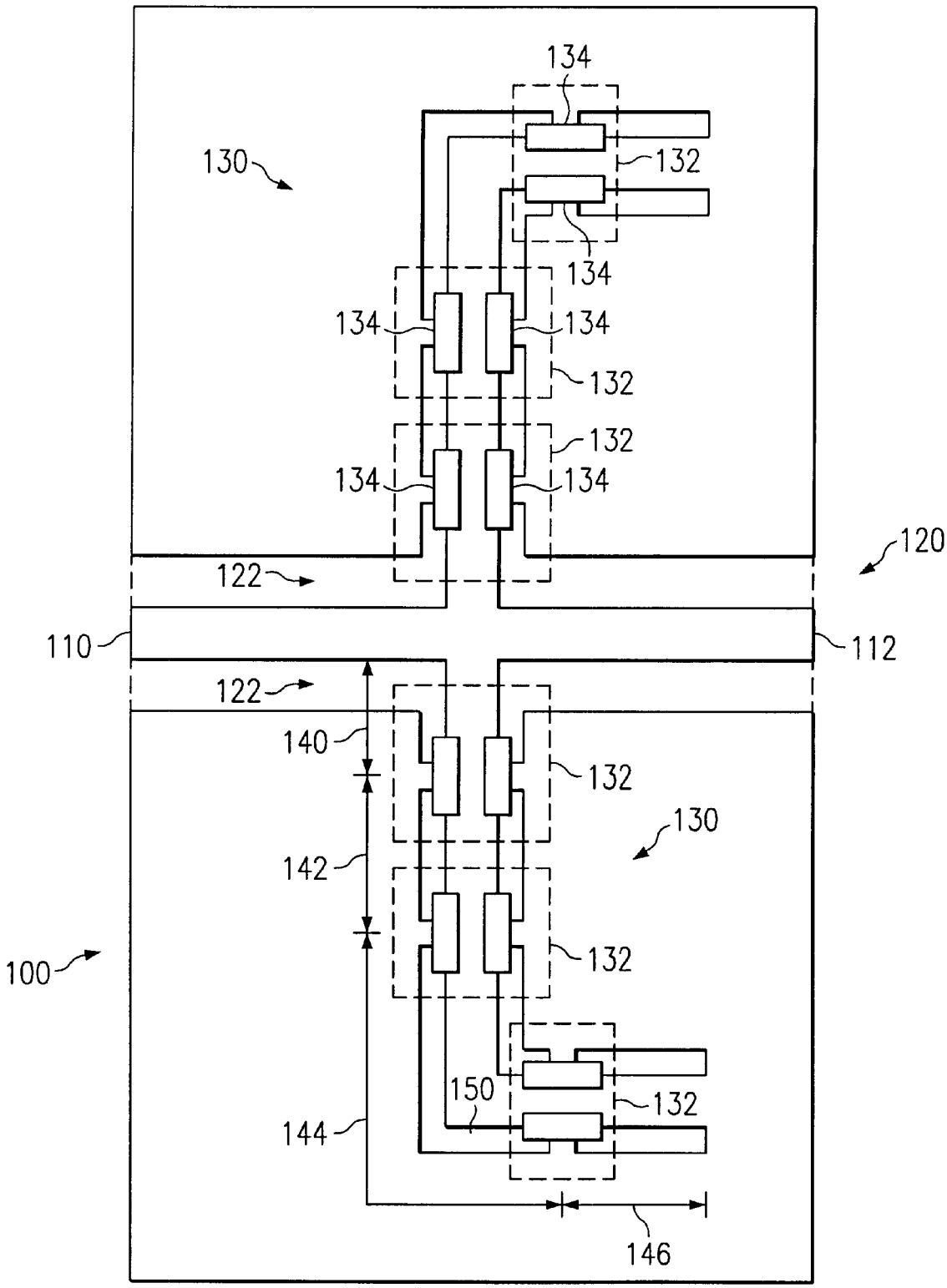
FIG. 1 illustrates a notch filter circuit in one embodiment of the present invention.

FIG. 1 is a diagram illustrating a notch filter circuit 100 in one embodiment of the present invention. Notch filter circuit 100 includes an input port 110 and an output port 112. Notch filter circuit 100 also includes a Coplanar Waveguide (CPW) 120 located on a substrate 122. Notch filter circuit 100 further includes at least one shunt stub 130. In one embodiment of the present invention, notch filter circuit 100 includes two symmetrical shunt stubs 130 located on opposite sides of CPW 120.

CPW 120 may be formed by placing metal layers (the light regions of FIG. 1) on a substrate 122 (the dark regions of FIG. 1). In one embodiment of the present invention, CPW 120 is formed from chromium-silver-chromium-gold (Cr—Ag—Cr—Au) metal layers total thickness, approximately one micron ($\mu$m); however, a CPW 120 formed from any suitable material and dimension is within the scope of the present invention. CPW 120 is formed by placing the metal layers on a silicon substrate 122, which in one embodiment is highly resistive. In one embodiment the silicon substrate is approximately 400 $\mu$m thick. Shunt stub 130 may also be formed by placing Cr—Ag—Cr—Au metal layers on silicon substrate 122. A shunt stub 130 formed from any suitable material is within the scope of the present invention. In one embodiment of the present invention, shunt stub 130 will be patterned in the same plane as CPW 120 and bent at an angle of ninety degrees relative to the longitudinal axis of CPW 120. Other configurations of shunt stub 130 may also be utilized. Shunt stub 130 includes at least one metal-insulator-metal (MIM) capacitor 132 located at a discontinuity of shunt stub 130; however, other types of capacitor 132 are within the scope of the present invention.

In one embodiment, symmetrical shunt stubs 130 are located on opposite sides of CPW 120. Input port 110 of notch filter circuit 100 is operable to receive an incoming microwave or millimeter-wave electronic signal and direct the signal into CPW 120. Shunt stubs 130 filter the signal, and the filtered signal will be output from CPW 120 at output port 112. For purposes of illustration shunt stubs 130 and CPW 120 are discussed as forming a notch filter circuit 100 operable to pass signals of 21 GHz and stop, or notch, signals of 42 GHz. For this example 21 GHz is the fundamental frequency signal, and 42 GHz is the second harmonic frequency signal. Notch filter circuit 100 may be designed to pass frequencies and to stop other particular frequencies, and it is envisioned that other notch filter circuits 100 so designed are also within the scope of the present invention.

In conventional shunt stub designs air bridges are placed at discontinuities within shunt stub 130 to suppress the propagation of undesired modes. A conventional shunt stub design locates air bridges where MIM capacitors 132 are located in notch filter circuit 100 of FIG. 1. When properly designed with an adequate bridge-height and minimum bridge-width, the air bridge introduces minimal parasitic effects to the conventional notch filter circuit. Conventional notch filter circuits implemented using air bridges occupy significant surface area in a circuit design as will be described below in greater detail.

Figure 2:
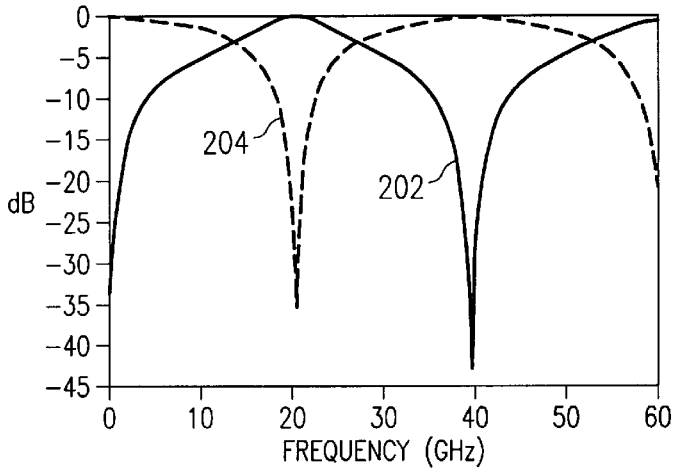
FIG. 2 graphically illustrates a simulated signal transmission curve and a simulated signal reflection curve for a conventional notch filter circuit containing air bridges.

FIG. 2 graphically illustrates the response of a conventional notch filter circuit wherein each shunt stub 130 includes a first air bridge located a distance 140 from CPW 120, a second air bridge located a distance 142 from the first air bridge, and a third air bridge located a distance 144 from the second air bridge and a distance 146 from the end of the conventional shunt stub. The air bridges of conventional notch filter circuits are not illustrated in FIG. 1 for reasons of clarity. In order to obtain a pass-band at a fundamental frequency and a stop-band at a second harmonic frequency, the total physical length of the conventional shunt stub is determined by dividing the guided wavelength of the fundamental frequency by four. Accordingly, in order to obtain a pass-band at 21 GHz and a stop-band at 42 GHz, the total physical length of the conventional shunt stub is approximately 1490 $\mu$m. Thus, distances 140, 142, 144, and 146 add to a total distance of 1490 $\mu$m.

Referring now to FIG. 2, there are graphically illustrated a simulated signal transmission curve 202 and simulated signal reflection curve 204 for a conventional notch filter circuit. An electromagnetically-simulated signal transmission curve 202 illustrates a high signal transmission at approximately 20 GHz and a very low signal transmission at approximately 40 GHz. An electromagnetically-simulated signal reflection curve 204 illustrates a high signal reflection at approximately 40 GHz and a very low signal reflection at approximately 20 GHz. Thus, a conventional notch filter circuit may be made to effectively pass a fundamental frequency signal while blocking a second harmonic frequency signal, although a conventional shunt stub length of 1490 $\mu$m is required.

According to the teachings of the invention, shunt stub 130 in one embodiment of the present invention is illustrated in FIG. 1 as including three MIM capacitors 132. A first MIM capacitor 132 is located a distance 140 from CPW 120, and a second MIM capacitor 132 is located a distance 142 from first MIM capacitor 132. A third MIM capacitor 132 is located a distance 144 from second MIM capacitor 132 and a distance 146 from the end of shunt stub 130. In one embodiment a silicon-oxide (SiO) layer 0.58 $\mu$m thick may be used as a dielectric 134 in MIM capacitors 132. Any suitable material or thickness of dielectric is within the scope of the present invention. By using MIM capacitors, notch filter circuit 100 is operable to attenuate a selected frequency with little effect on other frequencies. In some embodiments of the present invention, multiple MIM capacitors 132 are located at specific positions along the length of shunt stub 130 to allow the pass-band and stop-band of notch filter circuit 100 to be properly selected.

Figure 3:
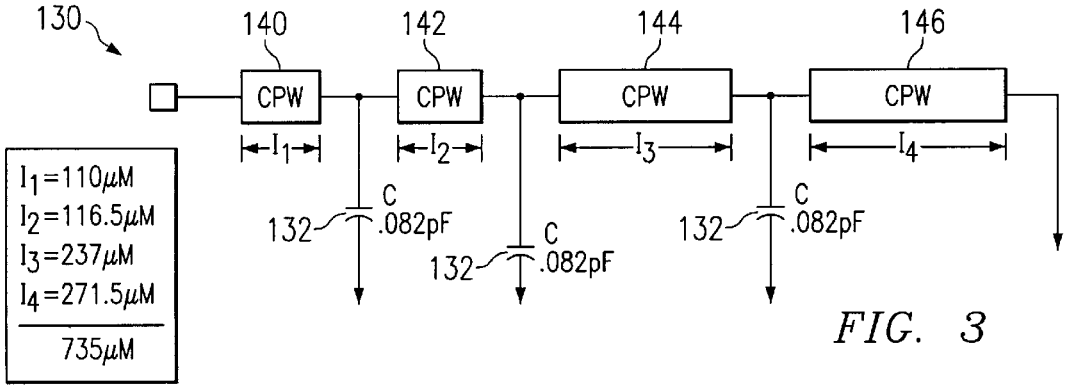
FIG. 3 illustrates a schematic diagram of a notch filter circuit in one embodiment of the present invention.

FIG. 3 illustrates a circuit model equivalent of notch filter circuit 100 of FIG. 1. In the illustrated embodiment MIM capacitors 132 are sized at 0.082 pF, and the locations of MIM capacitors 132 are indicated by distances 140, 142, 144, and 146. Through proper selection of shunt stub 130 parameters and MIM capacitor 132 values, it is possible to obtain an effective notch filter circuit 100 with a pass-band response at 21 GHz ($Z_{in,\ stub}$=infinity Ω) and a stop-band response at 42 GHz ($Z_{in,\ stub}$=0 Ω). $Z_{in,\ stub}$ is the shunt stub impedance with respect to a particular frequency signal. The total physical length of each shunt stub 130 in this embodiment is 735 $\mu$m. By replacing the air bridges with three MIM capacitors 132, therefore, shunt stub 130 may be reduced in size from 1490 $\mu$m to 735 $\mu$m.

The required surface area for notch filter circuit 100 may be significantly reduced by replacing the conventional air bridges with MIM capacitors 132 in shunt stubs 130. In microwave and millimeter-wave integrated circuits, compact layout is an important issue that is limited by both circuit cross-talk and component size. Filter size is particularly important, because the filters are often realized using distributed transmission line stubs that can occupy significant substrate space.

MIM capacitors 132 serve an additional function within notch filter circuit 100. MIM capacitors 132 are, in one embodiment, operable to provide CPW 120 ground equalization through the underlying metal by providing a direct current contact between the two ground paths of CPW 120. Ground equalization in conventional notch filter circuits has been accomplished using air bridges.

Figure 4:
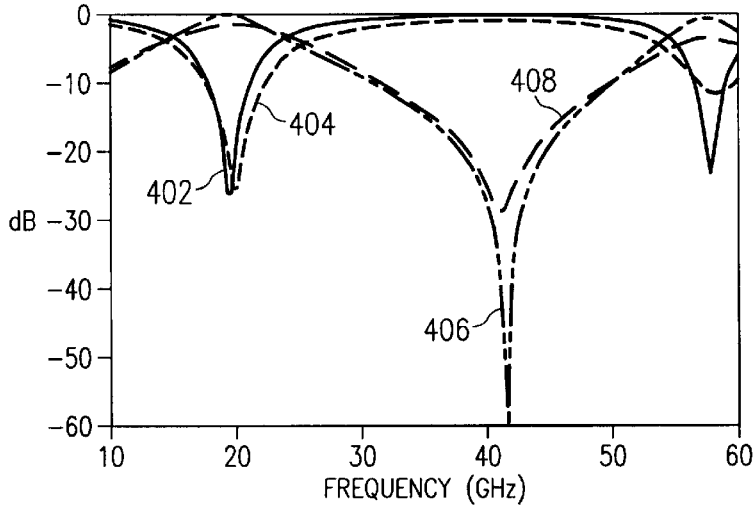
FIG. 4 graphically illustrates signal transmission curves and signal reflection curves for a notch filter circuit in one embodiment of the present invention.

Referring now to FIG. 4 there is graphically illustrated a comparison between electromagnetic simulation results and the measured response of notch filter circuit 100 employing MIM capacitor-loaded shunt stubs 130. A measured signal transmission curve 408 substantially matches the simulated signal transmission curve 406. Similarly, a measured signal reflection curve 404 substantially matches the simulated signal reflection curve 402. Measured signal transmission curve 408 illustrates a high signal transmission level at approximately 20 GHz and a low signal transmission level at approximately 40 GHz. Measured signal reflection curve 404 illustrates a high signal reflection level at approximately 40 GHz and a low signal reflection level at approximately 20 GHz. In one embodiment, the 3-dB pass-band bandwidth of notch filter circuit 100 is approximately 55 percent. The insertion loss is approximately 1 dB at 21 GHz and the rejection at 42 GHz is 30 dB. FIG. 4 illustrates that one embodiment of notch filter circuit 100 is operable to transmit a fundamental signal frequency and block a second harmonic frequency signal. Notch filter circuit 100 is operable to do so with shunt stubs 130 approximately 50 percent smaller than the shunt stubs in a conventional notch filter circuit.

Figure 5:
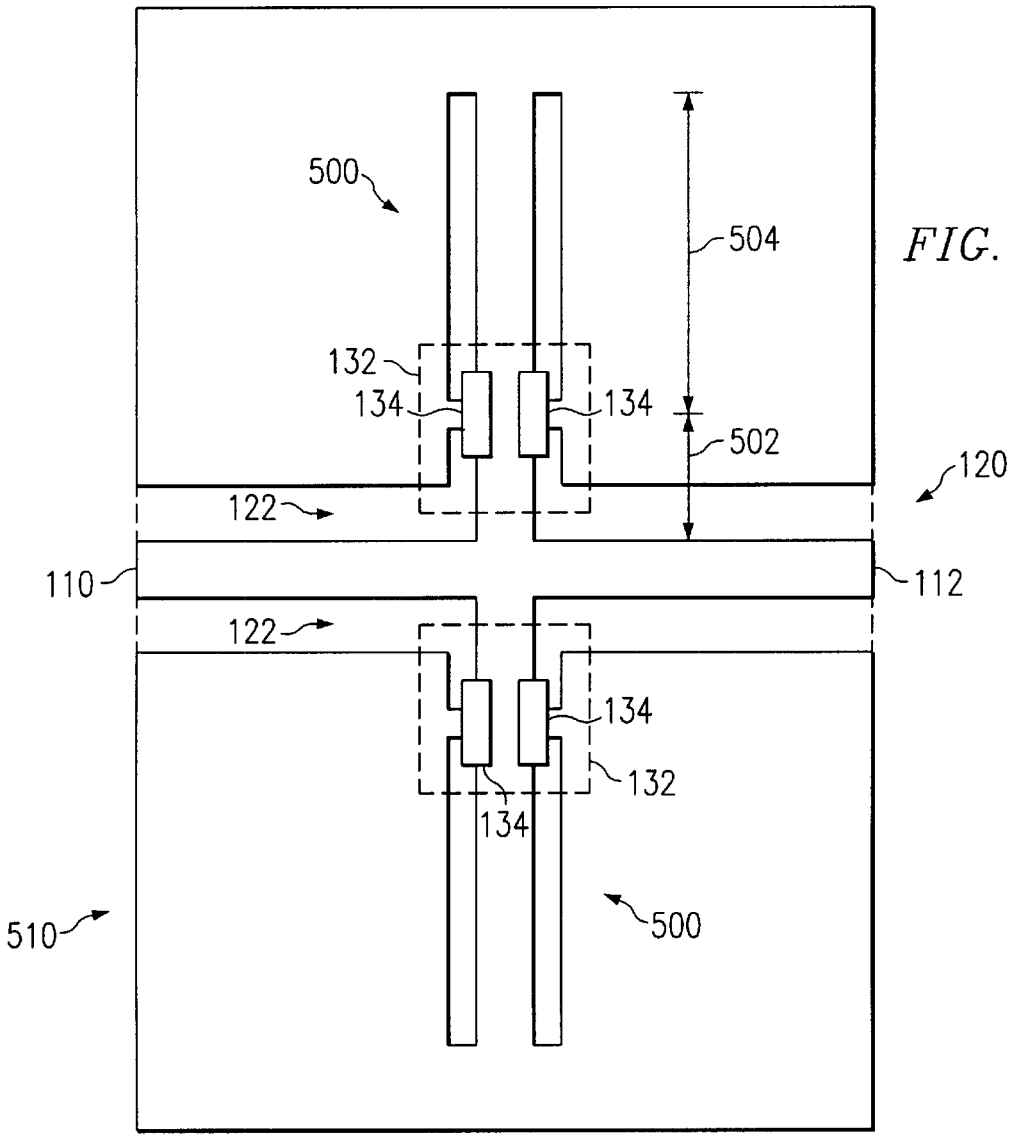
FIG. 5 illustrates a notch filter circuit that contains one metal-insulator-metal capacitor located in a straight shunt stub.

Referring now to FIG. 5 there is illustrated a notch filter circuit 510 embodying a MIM capacitor-loaded straight shunt stub topology. In this embodiment a single MIM capacitor 132 is located in each straight shunt stub 500. Neglecting parasitic effects, the impedance seen looking into straight shunt stub 500 is given by $$Z_{in,stub} = \frac{jZ_0\tan\theta}{1-\omega C Z_0\tan\theta}$$

In the equation ω is 2nf, where f is the frequency, C is the capacitance of MIM capacitor 132, $Z_0$ is the characteristic impedance, and θ is the electrical length of shunt stub 500. The above equation assumes that MIM capacitor 132 is located at the exact junction between CPW 120 and straight shunt stub 500. This means MIM capacitor 132 is located a zero distance 502 from CPW 120. To obtain the pass-band filter response at 21 GHz $Z_{in,\ stub}$=infinity Ω) a fixed C and $Z_0$ are used in the following equation:

$$\theta = \tan^{-1}\left(\frac{1}{\omega C Z_0}\right)$$

From this equation it is seen that θ decreases with increasing C, and θ will be less than 90° for any non-zero value of C. With C and $Z_0$ fixed however, it will not be possible to satisfy the filter stop-band response at the second harmonic frequency of 42 GHz ($Z_{in,\ stub}$=0 Ω), which requires θ to 180° .

An analysis of the circuit illustrated in FIG. 5, in which distance 502 is allowed to be non-zero, reveals that a single MIM capacitor 132 in a straight shunt stub 500 is operable to provide the desired responses at the pass-band and stop-band frequencies. Since MIM capacitor 132 serves a dual purpose of capacitive-loading of CPW 120 and ground plane equalization, it is important that MIM capacitor 132 be placed near the junction between shunt stub 500 and CPW 120 in this embodiment. Therefore, distance 502 should be minimized to the extent possible. Decreasing distance 502 requires that the size of MIM capacitor 132 increase. In one embodiment of the present invention, the correct pass-band and stop-band responses were obtained in notch filter circuit 510 with distances 502 and 504 equaling 110 μm and 300 μm, respectively, and a MIM capacitor 132 value of 0.65 pF. By way of contrast, notch filter circuit 100 as illustrated in FIG. 1 required only MIM capacitors 132 sized at 0.082 pF. Parasitic effects in MIM capacitor 132 of size 0.65 pF become noticeable in the 40–60 GHz range, however, which complicates the process of establishing the null at the desired second harmonic frequency.

Figure 6:
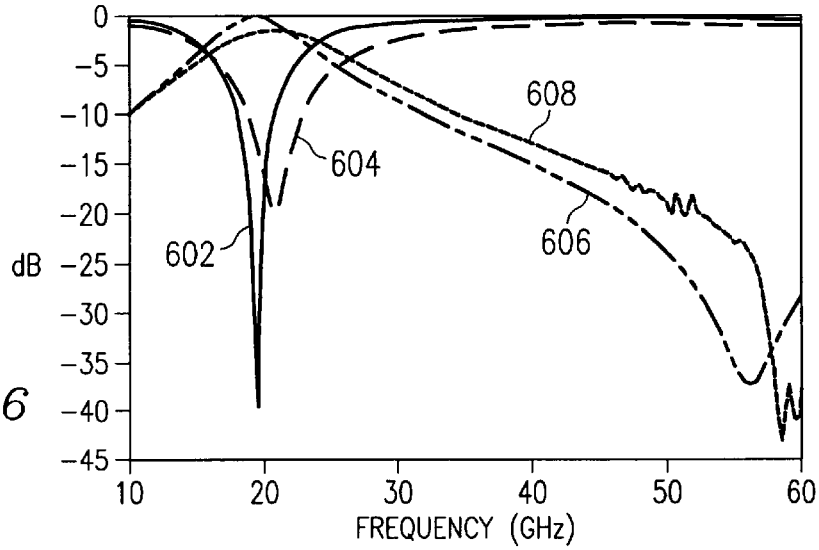
FIG. 6 graphically illustrates signal transmission curves and signal reflection curves for a notch filter containing one metal-insulator-metal capacitor located in a straight shunt stub.

Referring now to FIG. 6, there is graphically illustrated a comparison between a measured response and electromagnetic simulation results for a notch filter circuit 510 embodying the straight shunt stub topology. In this design distances 502 and 504 were 110 μm and 470 μm, respectively, and MIM capacitor 132 was sized at 0.275 pF. In FIG. 6 measured signal transmission curve 608 is similar to simulated signal transmission curve 606. Measured signal reflection curve 604 is similar to simulated signal reflection curve 602. Although not an optimal design for this application, the results illustrated in FIG. 6 demonstrate the presence of a controllable stop-band response at approximately 58 GHz.

Although the present invention has been described with several example embodiments, various changes and modifications may be suggested to one skilled in the art. It is intended that the present invention encompass those changes and modifications as they fall within the scope of the claims.

What is claimed is:

1. A notch filter circuit apparatus, comprising:

a coplanar waveguide located on a silicon-substrate;

at least one shunt stub; and at least one capacitor bridging a discontinuity of the at least one shunt stub.

2. The apparatus of claim 1, wherein the coplanar waveguide is comprised of a plurality of chromium-silver-chromium-gold metal layers.

3. The apparatus of claim 1, wherein the silicon substrate comprises a high-resistivity silicon substrate.

4. The apparatus of claim 1, wherein the at least one shunt stub is comprised of a plurality of chromium-silver-chromium-gold metal layers.

5. The apparatus of claim 1, wherein the at least one shunt stub is bent at an angle to the coplanar waveguide.

6. The apparatus of claim 1, wherein the at least one shunt stub is bent at an angle of ninety degrees to the coplanar waveguide.

7. The apparatus of claim 1, further comprising a first shunt stub located on an opposite side of the coplanar waveguide from a second shunt stub.

8. The apparatus of claim 7, wherein the first shunt stub is symmetrical with the first shunt stub about the coplanar waveguide.

9. The apparatus of claim 1, wherein the at least one capacitor comprises a metal-insulator-metal capacitor.

10. A system for filtering an electrical signal, comprising:

a coplanar waveguide located on a silicon substrate;

a first shunt stub, with a bend of ninety degrees with respect to the longitudinal axis of the coplanar waveguide;

a second shunt stub, located on an opposite side of the coplanar waveguide, and symmetrical to the first shunt stub about the coplanar waveguide;

at least one metal-insulator-metal capacitor bridging a discontinuity of the first shunt stub; and at least one metal-insulator-metal capacitor bridging a discontinuity of the second shunt stub.

11. The system of claim 10, wherein the coplanar waveguide is comprised of a plurality of chromium-silver-chromium-gold metal layers.

12. The system of claim 10, wherein the silicon substrate comprises a high-resistivity silicon substrate.

13. The system of claim 10, wherein the first and second shunt stubs are comprised of a plurality of chromium-silver-chromium-gold metal layers.

14. A system for filtering an electrical signal, comprising:

a coplanar waveguide located on a silicon substrate;

a first shunt stub at a right angle to the coplanar waveguide;

a second shunt stub, symmetrical with the first shunt stub about the coplanar waveguide;

at least one metal-insulator-metal capacitor bridging a discontinuity of the first shunt stub; and at least one metal-insulator-metal capacitor bridging a discontinuity of the second shunt stub.

15. The system of claim 14, wherein the coplanar waveguide is comprised of a plurality of chromium-silver-chromium-gold metal layers.

16. The system of claim 14, wherein the silicon substrate comprises a high-resistivity silicon substrate.

17. The system of claim 14, wherein the first and second shunt stubs are comprised of a plurality of chromium-silver-chromium-gold metal layers.

* * * * *